US012472416B2

(12) United States Patent
Han

(10) Patent No.: US 12,472,416 B2
(45) Date of Patent: Nov. 18, 2025

(54) GOLF SWING TRAINING APPARATUS

(71) Applicant: GOLFZON Co., Ltd., Seoul (KR)

(72) Inventor: Noori Han, Seoul (KR)

(73) Assignee: GOLFZON Co., Ltd., Seoul (KR)

( * ) Notice: Subject to any disclaimer, the term of this patent is extended or adjusted under 35 U.S.C. 154(b) by 318 days.

(21) Appl. No.: 18/308,843

(22) Filed: Apr. 28, 2023

(65) Prior Publication Data

US 2023/0264091 A1 Aug. 24, 2023

Related U.S. Application Data

(63) Continuation of application No. PCT/KR2021/012873, filed on Sep. 17, 2021.

(30) Foreign Application Priority Data

Dec. 22, 2020 (KR) ..... 10-2020-0181385

(51) Int. Cl.
*A63B 69/36* (2006.01)

(52) U.S. Cl.
CPC ..... *A63B 69/3632* (2013.01); *A63B 2209/08* (2013.01)

(58) Field of Classification Search
CPC ..... A63B 69/3632; A63B 2209/08; A63B 15/005; A63B 2071/0655; A63B 69/3623; A63B 69/3638; A63B 21/00196; A63B 24/0021; A63B 69/3614; A63B 69/3655; A63B 2024/0028
USPC ..... 473/203–206, 219–226, 231–234, 256, 473/257, 266, 457
See application file for complete search history.

(56) References Cited

U.S. PATENT DOCUMENTS 2,532,646 A * 12/1950 Severin ..... A63F 7/2472 473/251
4,027,886 A * 6/1977 Katsube ..... A63B 69/3632 273/456
4,295,832 A * 10/1981 Karell ..... G09B 1/08 434/168
6,955,610 B1 * 10/2005 Czaja ..... A63B 60/04 473/226

(Continued)

FOREIGN PATENT DOCUMENTS

CN 102316941 A 1/2012
JP 2001-009077 A 1/2001

(Continued)

*Primary Examiner* — Nini F Legesse
(74) *Attorney, Agent, or Firm* — Sughrue Mion, PLLC

(57) ABSTRACT

Proposed herein is a golf swing training apparatus for providing sensations of hitting for golf swing practice. The golf swing training apparatus includes: a shaft body formed to a predetermined length, and configured such that a grip and a stopper are formed at both ends thereof, respectively, and a metal region is formed in a part thereof on a grip side thereof; an impact ball coupled to be movable along the longitudinal direction of the shaft body, configured to provide weight for the generation of a sensation of hitting, and provided with a plurality fitting slots; and a plurality of magnets configured to be detachably fitted into one or more of the fitting slots of the impact ball, configured to hold the impact ball to the metal region, and configured to allow the strength of the action of attraction to be adjusted.

10 Claims, 9 Drawing Sheets

(56) References Cited

U.S. PATENT DOCUMENTS

| | | | | |
|---|---|---|---|---|
| 7,798,910 | B2 * | 9/2010 | Leadbetter ..... | A63B 69/3614<br>473/215 |
| 9,687,718 | B1 * | 6/2017 | Sorenson ..... | A63B 69/0091 |
| 2011/0034275 | A1 | 2/2011 | Kim | |
| 2011/0300963 | A1 | 12/2011 | Kim | |
| 2017/0291090 | A1 | 10/2017 | Wang | |

FOREIGN PATENT DOCUMENTS

| | | | |
|---|---|---|---|
| JP | 2012-517878 | A | 8/2012 |
| JP | 2020-18672 | A | 2/2020 |
| KR | 10-2009-0119712 | A | 11/2009 |
| KR | 10-2010-0082253 | A | 7/2010 |
| KR | 10-1115633 | B1 | 2/2012 |
| KR | 10-1507569 | B1 | 4/2015 |
| KR | 20-2015-0001269 | U | 4/2015 |
| KR | 10-2019-0021597 | A | 3/2019 |
| WO | 2018/118926 | A1 | 6/2018 |

* cited by examiner

GOLF SWING TRAINING APPARATUS

TECHNICAL FIELD

The embodiments disclosed herein relate to a golf swing training apparatus, and more particularly, to a golf swing training apparatus capable of fixing a weight element, which provides sensations of hitting while being moved by a centrifugal force caused by a swing, by a magnetic force.

BACKGROUND ART

Generally, golf is an exercise in which a golfer hits a golf ball and puts it in a hole at a desired place, and has recently become a popular sport.

In this case, the goal of a golf swing is to accurately fly a golf ball over a desired distance in a desired direction while moving the head of a golf club along a specific trajectory.

Such golf swings can prevent miss shots only when they are provided with an appropriate rhythm, and golf balls can be flown away only when the fastest speed is obtained upon impact.

Accordingly, there have been proposed practice devices for practicing golf swings.

As related prior art, there is a 'golf swing practice bat' disclosed in Korean Utility Model Registration Application Publication No. 20-2015-0001269.

More specifically, the prior art proposes a practice bat that includes a shaft including a rod-shaped shaft body and a grip part formed at one end of the shaft body so that a user can grip it, a weight element coupled to the other end of the shaft body, a fixing ring fitted and coupled into the shaft body, a movable part including a movable element slidably fitted over the shaft body between the fixing ring and the weight element, a magnet provided in the fixing ring, and a contact separation part made of a metallic material, provided in the movable element, and configured to come into contact with the fixing ring by the magnet and be separated from the fixing ring by a centrifugal force during a swing.

This prior art is a technology in which the movable element is separated from the fixing ring and moved to the weight element during the swing of the shaft, thereby providing the timing of impact.

However, the above-described prior art has a configuration in which the magnetic force of the magnet for fixing the movable element cannot be adjusted, so that there is a problem in that it cannot provide a variety of sensations of weight.

In addition, the prior art also has a problem in that the fixed position of the movable element cannot be adjusted.

Therefore, there is a demand for technology for overcoming the above-described problems.

Meanwhile, the above-described background technology corresponds to technical information that has been possessed by the present inventor in order to contrive the present invention or that has been acquired in the process of contriving the present invention, and can not necessarily be regarded as well-known technology that had been known to the public prior to the filing of the present invention.

DISCLOSURE

Technical Problem

An object of the embodiments disclosed herein is to provide a golf swing training apparatus capable of providing a variety of sensations of weight through the different strengths of magnetic forces by allowing the strength of a magnetic force to be adjusted while fixing an impact ball, which provides a sensation of hitting through the movement thereof caused by a swing, to a shaft through the action of attraction caused by the magnetic force of a magnet.

More specifically, an object of the embodiments disclosed herein is to provide a golf swing training apparatus capable of allowing the strength the action of attraction caused by a magnetic force to be adjusted by allowing a selected number of magnets, which provide a magnetic force in a state of being coupled into an impact ball, to be coupled into the impact ball.

In addition, an object of the embodiments disclosed herein is to provide a golf swing training apparatus capable of allowing the initial position of an impact ball together with the strength of a magnetic force to be adjusted through the setting of a distance by enabling the distance between a magnet coupled into the impact ball and the metal region of a shaft body to be set differently.

In addition, an object of the embodiments disclosed herein is to provide a golf swing training apparatus capable of adding weight to an impact ball that provides weight.

Technical Solution

As a technical solution for overcoming the above-described technical problem, according to an embodiment, there is provided a golf swing training apparatus for providing sensations of hitting for golf swing practice, the golf swing training apparatus including: a shaft body formed to a predetermined length, and configured such that a grip and a stopper are formed at both ends thereof, respectively, in a longitudinal direction thereof and a metal region made of a metallic material is formed in a part thereof on a grip side thereof; an impact ball coupled to be movable along the longitudinal direction of the shaft body, configured to provide weight for the generation of a sensation of hitting while being moved in a direction opposite to that of the grip by the centrifugal force caused by the swing of the shaft body and then being stopped by the stopper, and provided with a plurality fitting slots; and a plurality of magnets configured to be detachably fitted into one or more of the fitting slots of the impact ball, configured to hold the impact ball to the metal region through the action of attraction with the metal region while providing a magnetic force, and configured to allow the strength of the action of attraction to be adjusted while providing a magnetic force having a different strength depending on the number of magnets coupled into the fitting slots.

Advantageous Effects

According to any one of the above-described technical solutions, there may be proposed the golf swing training apparatus in which the plurality of magnets providing a magnetic force are detachably coupled into the fitting slots formed in the impact ball, so that the strength of a magnetic force can be adjusted by adjusting the number of magnets, with the result that the strength of the action of attraction can be adjusted through different strengths of magnetic forces, thereby providing a variety of sensations of weight.

In addition, according to any one of the above-described technical solutions, there may be proposed the golf swing training apparatus in which the weight block coupled into the fitting slot provides the same shape and weight as the magnet, so that the same weight can be provided through some weight blocks even when some of the magnets are omitted.

In addition, according to any one of the above-described technical solutions, there may be proposed the golf swing training apparatus in which, when the different outer diameters of the metal region are formed for respective regions, the different distances between the magnet and the metal region forming the action of attraction with the magnet may be set for the respective regions, so that the initial position of the impact ball together with the strength of a magnetic force can be adjusted through the setting of the distances.

In addition, according to any one of the above-described technical solutions, there may be proposed the golf swing training apparatus in which the first and second impact balls constituting the impact ball are formed to have different weights and are coupled through the configuration of the ball fixing part, so that the weight can be adjusted by detaching the second impact ball when necessary.

In addition, according to any one of the above-described technical solutions, there may be proposed the golf swing training apparatus in which, when the inner diameters of the first and second impact balls are formed to be different, the different distances from the magnet and the metal region are set for the respective impact balls, so that the initial position of the impact ball together with the strength of a magnetic force can be adjusted through the setting of the distances.

In addition, according to any one of the above-described technical solutions, there may be proposed the golf swing training apparatus capable of obtaining data on swing practice by providing information such as the swing trajectory of the shaft body through the configuration of the IR detector.

The effects that can be obtained by the embodiments disclosed herein are not limited to the effects described above, and other effects not described above will be clearly understood by those of ordinary skill in the art to which the present invention pertains from the following description.

MODE FOR INVENTION

Figure 1:
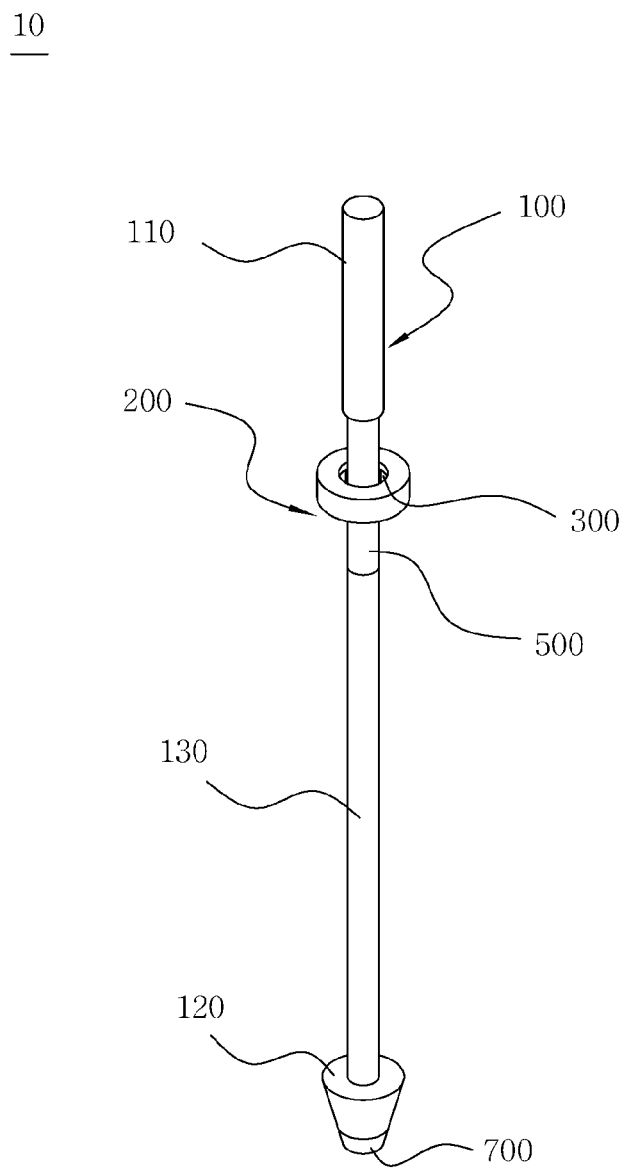
FIG. 1 is a diagram showing the configuration of a golf swing training apparatus according to an embodiment.

Various embodiments will be described in detail below with reference to the accompanying drawings. The following embodiments may be modified to various different forms and then practiced. In order to more clearly illustrate features of the embodiments, detailed descriptions of items that are well known to those of ordinary skill in the art to which the following embodiments pertain will be omitted. Furthermore, in the drawings, portions unrelated to descriptions of the embodiments will be omitted. Throughout the specification, like reference symbols will be assigned to like portions.

Throughout the specification, when one component is described as being "connected" to another component, this includes not only a case where the one component is "directly connected" to the other component but also a case where the one component is "connected to the other component with a third component disposed therebetween." Furthermore, when one portion is described as "including" one component, this does not mean that the portion does not exclude another component but means that the portion may further include another component, unless explicitly described to the contrary.

The embodiments will be described in detail below with reference to the accompanying drawings.

Figure 2:
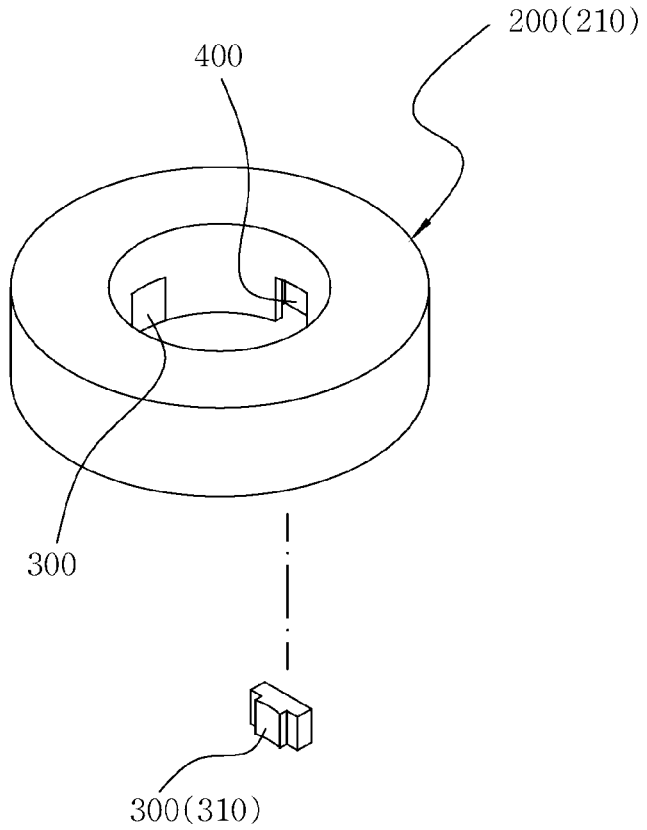
FIG. 2 is a perspective view showing the impact ball of the golf swing training apparatus according to the embodiment.
Figure 3:
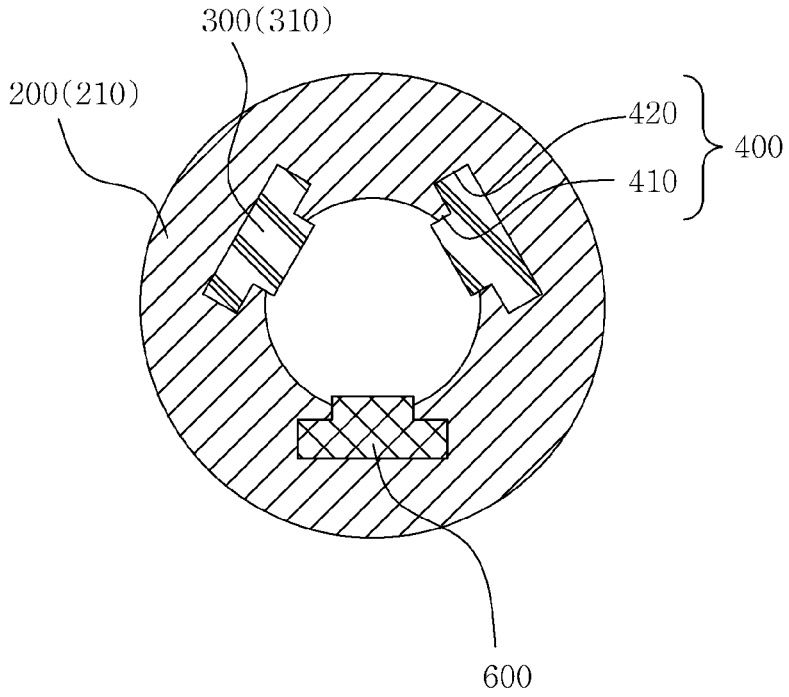
FIG. 3 is a cross-sectional view showing the impact ball of the golf swing training apparatus according to the embodiment.
Figure 4:
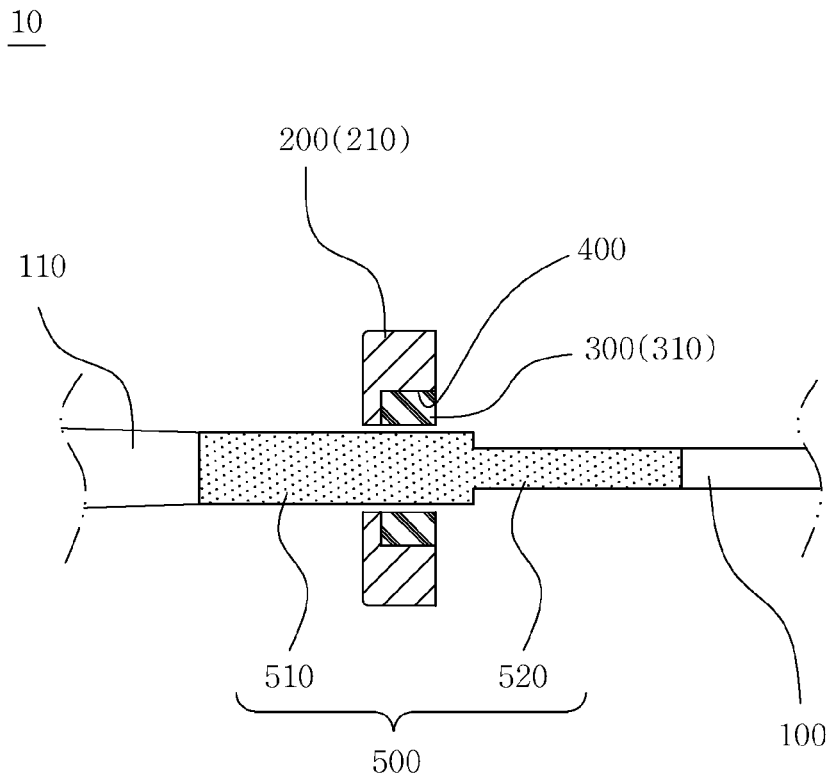
FIG. 4 is a longitudinal sectional view showing another embodiment of a metal region constituting a part of a shaft body.
Figure 5:
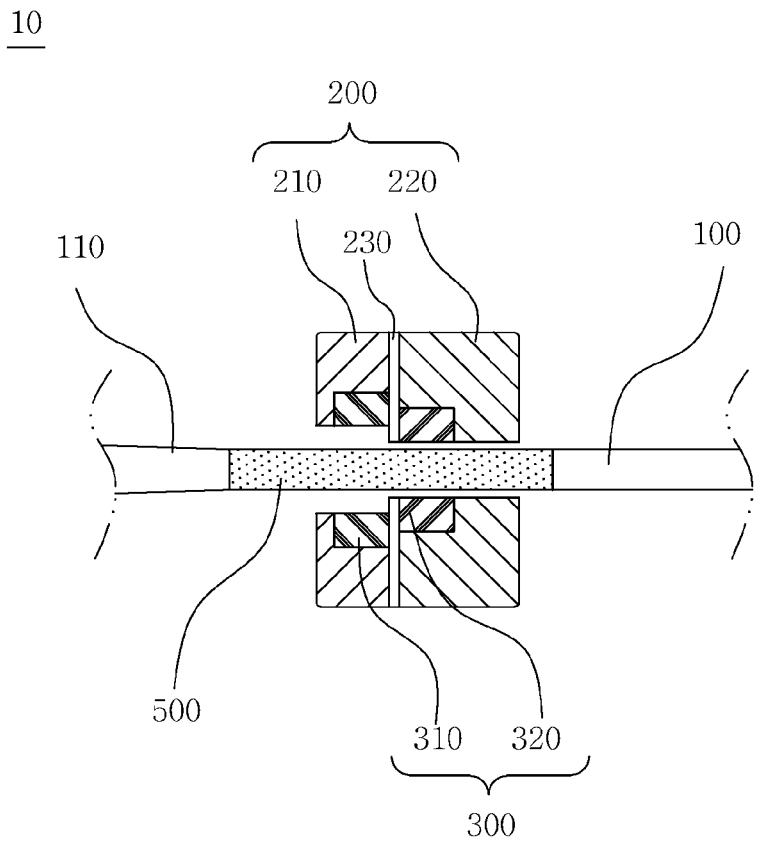
FIGS. 5 and 6 are views showing another embodiment of the impact ball.
Figure 6:
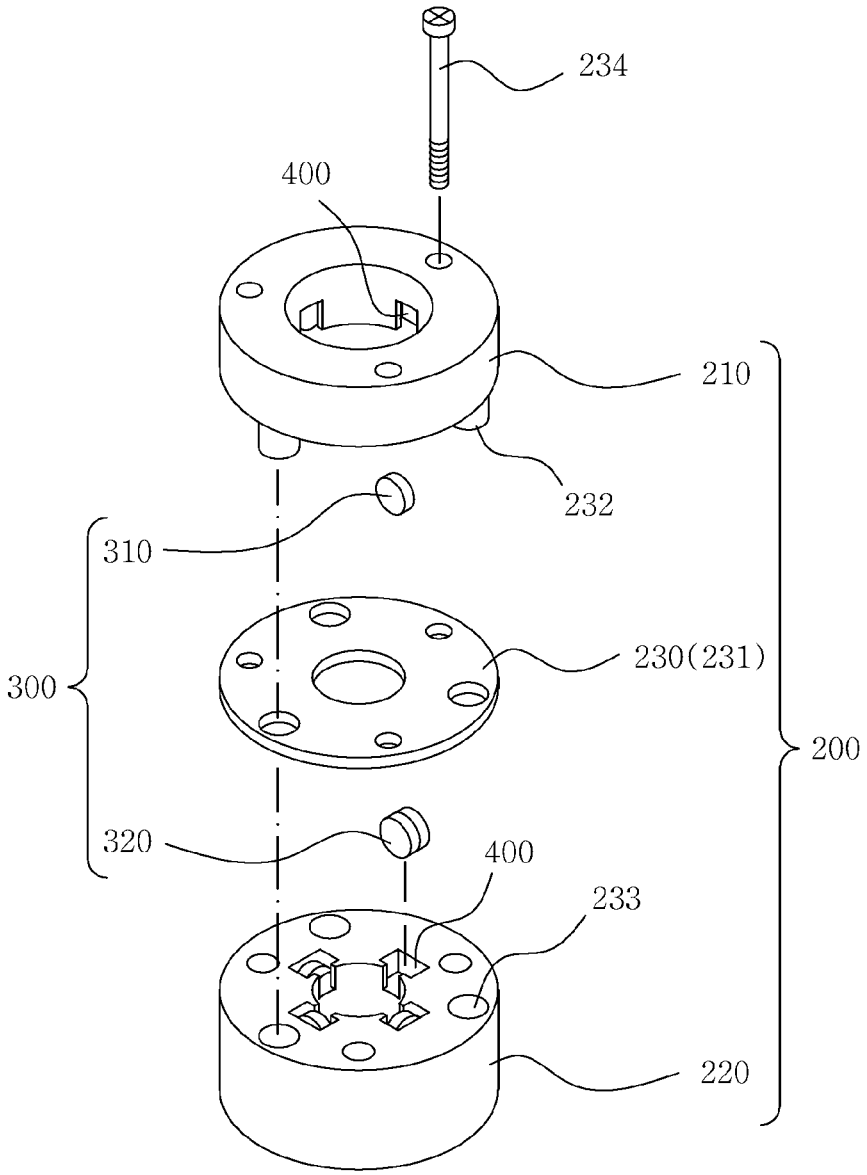
Figure 7:
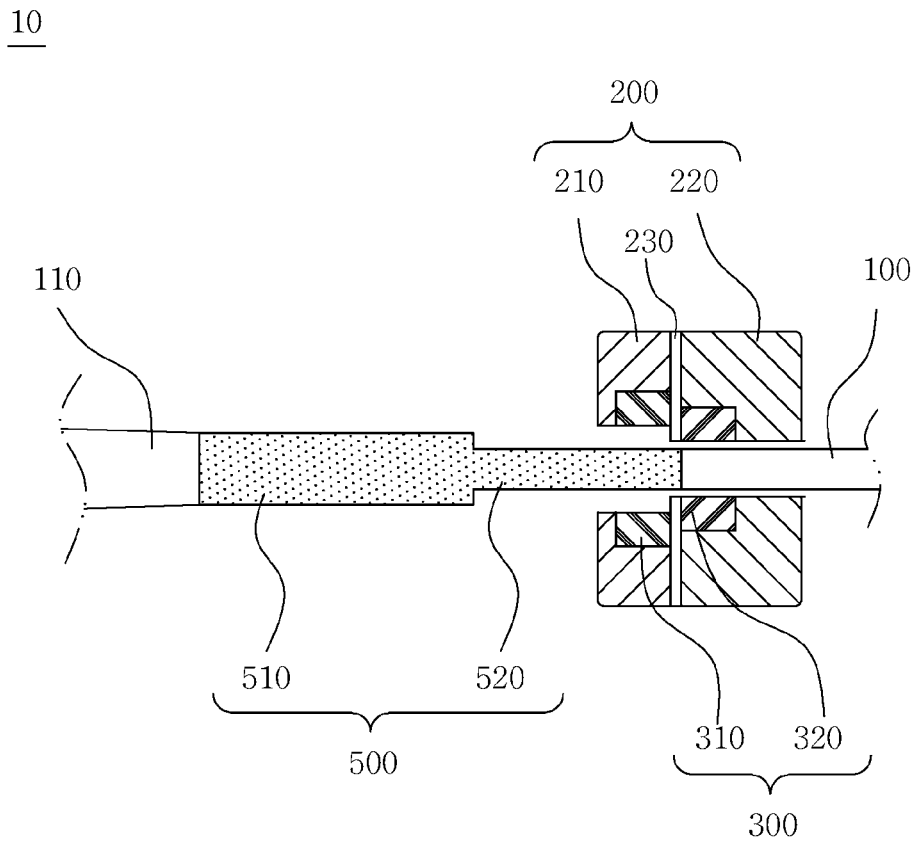
FIGS. 7 to 9 are longitudinal sectional views showing states in which the impact ball is fixed to the metal region in a stepwise manner.
Figure 8:
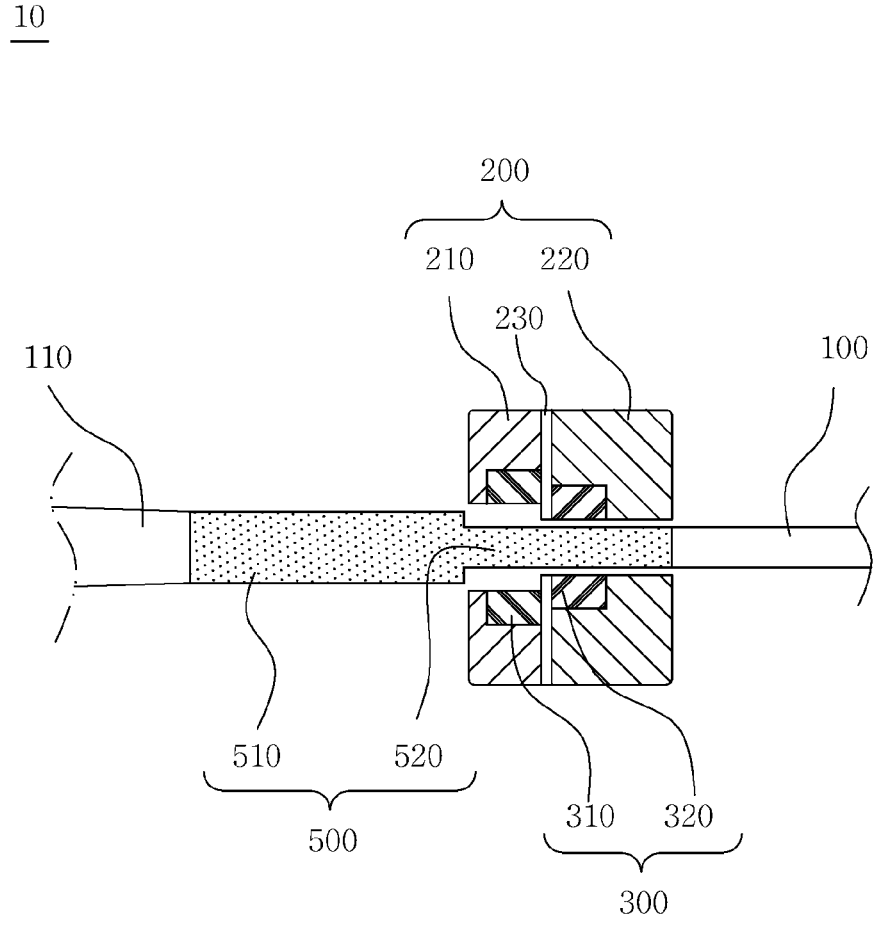
Figure 9:
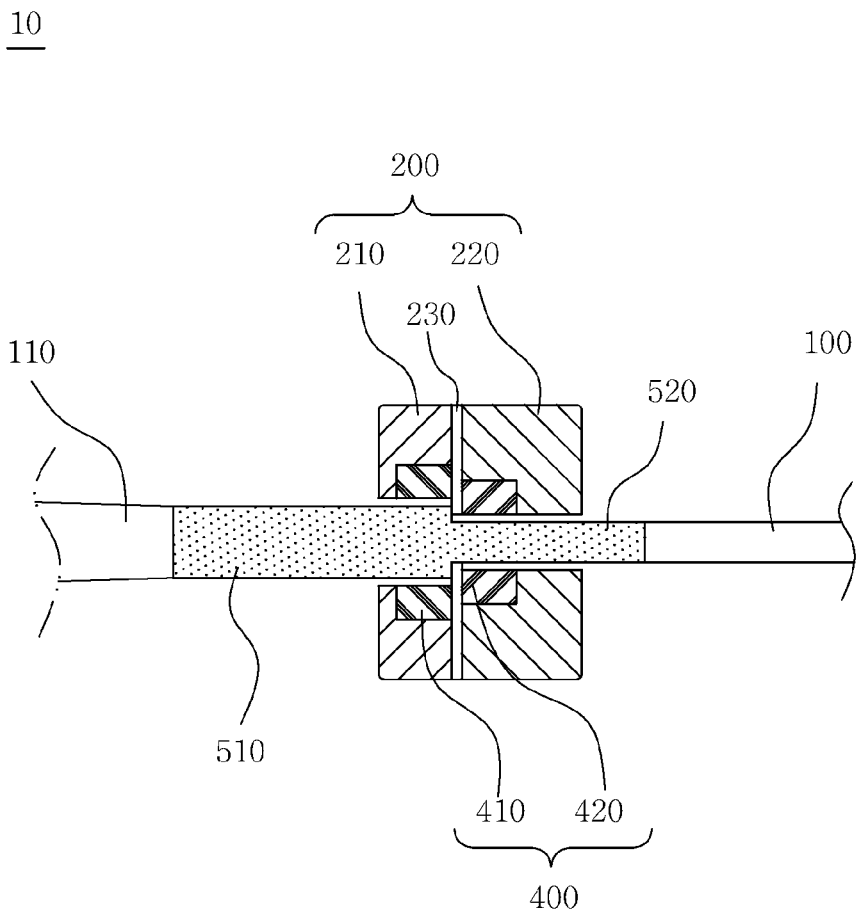

FIG. 1 is a diagram showing the configuration of a golf swing training apparatus according to an embodiment, FIG. 2 is a perspective view showing the impact ball of the golf swing training apparatus according to the embodiment, and FIG. 3 is a cross-sectional view showing the impact ball of the golf swing training apparatus according to the embodiment. Furthermore, FIG. 4 is a longitudinal sectional view showing another embodiment of a metal region constituting a part of a shaft body, FIGS. 5 and 6 are views showing another embodiment of the impact ball, and FIGS. 7 to 9 are longitudinal sectional views showing states in which the impact ball is fixed to the metal region in a stepwise manner.

A golf swing training apparatus 10 according to an embodiment is a device for providing sensations of hitting through a moving weight element during swing practice.

As shown in FIG. 1, a golf swing training apparatus 10 may be configured to include a shaft body 100, an impact ball 200, and a magnet 300.

The shaft body 100 is a component that is swung while being held in a user's hand for swing practice. The shaft body 100 may be formed to a predetermined length while forming a bar shape corresponding to a conventional golf club. A grip 110 is formed at the upper one of both ends in the longitudinal direction thereof and may be gripped by a user.

In addition, the shaft body 100 has a stopper 120 installed at the end thereof opposite to the grip 110, so that a ball rail 130, which is a movement section for the impact ball 200 to be described later, can be provided between the grip 110 and the stopper 120.

The stopper 120 may limit the movement distance of the impact ball 200 by providing a stop portion for the impact ball 200 at an end of the ball rail 130.

In this case, the ball rail 130 is made of a non-metallic material, so that it may provide a movement path for the impact ball 200 without reacting with the magnetic force of the magnets 300 to be described later.

In addition, a metal region 500 made of a metallic material may be formed in a portion of the grip (110) side of the shaft body 100.

More specifically, the metal region 500 is a component that holds the impact ball 200 to the upper one of both ends of the ball rail 130 in the longitudinal direction, i.e., the end of the ball rail 130 opposite to the stopper 120, through the action of attraction with the magnet 300 installed in the impact ball 200 to be described later.

As shown in FIGS. 1 and 5, the metal region 500 may be formed of a single region while forming a uniform outer diameter. As shown in FIG. 4, the metal region 500 may be configured to include a first region 510 and a second region 520 while forming a plurality of regions.

The impact ball 200 is a component that is coupled to be movable along the longitudinal direction of the shaft body 100 and provides a weight for the generation of sensations of hitting while being moved by the centrifugal force caused by the swing of the shaft body 100.

More specifically, as shown in FIG. 1, the impact ball 200 is formed as a weight element forming a ring shape, and may be fitted and coupled to be movable along the longitudinal direction of the ball rail 130 formed in the shaft body 100.

Furthermore, as shown in FIGS. 2 and 3, a plurality of fitting slots 400 constituting coupling portions for the magnet 300 to be described later are formed in the impact ball 200, so that the impact ball 200 in a state of being fixed to the metal region 500 through the magnet 300 is moved by a centrifugal force and then stopped by the stopper 120 when the shaft body 100 is swung, thereby providing a sensation of hitting.

As shown in FIGS. 1 and 4, the impact ball 200 may be configured to include a first impact ball 210 while forming a single impact ball. As shown in FIGS. 5 and 6, the impact ball 200 may be configured to include a first impact ball 210, a second impact ball 220, and a ball fixing part 230 while forming a plurality of impact ball.

The first impact ball 210 is formed in a ring shape having an inner diameter larger than the outer diameter of the metal region 500, and is fixed to the metal region 500 through the action of attraction caused by the magnetic force of the magnet 300 to be described later. In this case, the first impact ball 210 may be fixed by an attractive force having a different strength depending on the number of magnets 300.

The first impact ball 210 may be made of a non-metallic material, or otherwise, may be made of a metallic material.

As shown in FIG. 3, the first impact ball 210 has a plurality of fitting slots 400 formed along the inner circumference thereof, thereby providing coupling portions for the magnet 300 to be described later.

In this case, the fitting slots 400 may be formed along the inner circumference of the first impact ball 210 while forming a plurality of slots and also forming a radial arrangement, as shown in FIG. 3. The fitting slots 211 may provide coupling portions for the magnet 300 through the configuration of exposure openings 410.

More specifically, the exposure openings 410 may receive the magnet 300 by being formed as openings that are depressed in the longitudinal direction of the first impact ball 210. The exposure openings 410 are opened toward the inner surface of the first impact ball 210 and allow the magnet 300 to face the metal region 500 while exposing the magnet 300, thereby fixing the first impact ball 210 to the metal region 500.

Furthermore, the fitting slots 400 may be configured to further include the configuration of holding recesses 420. The holding recesses 420 may be formed as recesses each having a stepped cross section on one side of each of the above-described exposure recesses 410, thereby providing holding portions for the magnets 300.

The magnet 300 provides a magnetic force for the fixing of the impact ball 200 to the metal region 500 described above. The magnet 300 may be formed of a plurality of magnets 300, and the plurality of magnets 300 may be coupled into the fitting slots 400 provided in the impact ball 200.

These magnets 300 may be disposed along the inner circumference of the impact ball 200 in a state of being coupled into the fitting slots 400, and may hold the impact ball 200 to the metal region 500 through the action of attraction with the metal region 500 while facing the metal region 500.

In this case, the magnet 300 is formed of a plurality of magnets, and thus provides a different magnetic force depending on the number of magnets coupled into the fitting slots 400, thereby allowing the strength of the action of attraction to be adjusted.

In other words, the magnets 300 may provide a stronger magnetic force when the magnets 300 are coupled into all of the plurality of fitting slots 400, and may provide a weaker magnetic force when the magnets 300 are coupled into only some of the fitting slots 400.

In this case, the magnets 300 may be formed in a shape corresponding to the cross section of the fitting slots 400 and be coupled into the fitting slots 400 through fitting, as shown in FIGS. 2 and 3. As shown in FIG. 6, the magnets 300 may be formed in a circular lithium battery shape, and a predetermined number of magnets 300 may be coupled into each of the fitting slots 400.

Meanwhile, the golf swing training apparatus 10 according to one embodiment may be configured to further include a weight block 600, as shown in FIG. 3.

The weight block 600 is a component for providing weight corresponding to each of the magnets 300. The weight block 600 may be formed to have the same shape and weight as the magnet 300, and may be coupled into the fitting slot 400 into which the magnet 300 is not coupled among the fitting slots 400 of the impact ball 200.

In this case, when the impact ball 200 is formed of a single first impact ball 210, the magnet 300 may be formed of a plurality of first magnets 300, and the plurality of first magnets 300 may be selectively coupled into the fitting slot 400 of the first impact ball 210. When the impact ball 200 is formed of a first impact ball 210 and a second impact ball 220, the magnet 300 may be configured to include a plurality of second magnets 320 that are selectively coupled into the fitting slots 400 of the second impact balls 220.

More specifically, a selected number of first magnets 310 may be coupled into the fitting slots 400 provided in the first impact ball 210, and may face the metal region 500 at a predetermined interval while being exposed to the inner surface of the first impact ball 210 through exposure openings 410 constituting parts of the fitting slots 400.

Furthermore, a selected number of second magnets 320 may be coupled into the fitting slots 400 provided in the second impact ball 220, and may face the metal region 500 at a predetermined interval while being exposed to the inner surface of the first impact ball 210 through exposure openings 410 constituting parts of the fitting slots 400.

Meanwhile, the impact ball 200 may be formed of the first impact ball 210 and the second impact ball 220, and may be coupled to each other through the ball fixing part 230, as shown in FIGS. 5 and 6.

More specifically, the second impact ball 220 may increase the weight of the first impact ball 210 by being coupled to the first impact ball 210 through the ball fixing part 230 to be described later.

The second impact ball 220 may be formed in a ring shape having a different weight and inner diameter from the first impact ball 210 and be coupled to the first impact ball 210, and the fitting slots 400 forming coupling portions for the second magnets 320 may be formed in the second impact ball 220.

It is obvious that the second impact ball 220 may be formed in a ring shape having the same weight and inner diameter as the first impact ball 210.

Furthermore, the second impact ball 220 may be made of a non-metallic material, or otherwise, may be made of a metallic material.

In this case, the second impact ball 220 may be formed to have a smaller inner diameter than the first impact ball 210, as shown in FIG. 5. Accordingly, the second magnets 320 coupled into the fitting slots 400 may be spaced apart from the metal region 500 at a shorter interval than the first magnets 310 of the first impact ball 210.

In other words, the second impact ball 220 is spaced apart from the metal region 500 at a shorter interval than the first impact ball 210, and thus, may be fixed to the metal region 500 by a weaker attractive force than the first impact ball 210.

The ball fixing part 230 is a component that couples and fixes the first impact ball 210 and the second impact ball 220 to each other.

As shown in FIG. 6, the ball fixing part 230 may be configured to include a buffer plate 231, centering protrusions 232, centering depressions 233, and fastening bolts 234.

The buffer plate 231 buffers an impact applied to a contact area and also seals the contact area while being fixed in a state of being interposed between the first impact ball 210 and the second impact ball 220.

In this case, the buffer plate 231 may block the fitting slots 400 of the first impact ball 210 and the fitting slots 400 of the second impact ball 220 while being interposed between the first impact ball 210 and the second impact ball 220.

Accordingly, the first magnets 310 and the second magnets 320 may be prevented from being separated from the fitting slots 400 of the first impact ball 210 and the fitting slots 400 of the second impact ball 220 by the buffer plate 231.

Meanwhile, the magnets 300 may be prevented from being separated from the fitting slots 400 by coupling blocking members, such as caps made of an injection-molded material, into the fitting slots 400 in a state in which the magnets 300 are coupled into the fitting slots 400.

The centering protrusions 232 form male members for coupling the first impact ball 210 and the second impact ball 220 to each other. The centering protrusions 232 may protrude from any one of the first impact ball 210 and the second impact ball 220 while forming a plurality of protrusions, and may pass through the buffer plate 231.

The centering depressions 233 form female members for coupling the first impact ball 210 and the second impact ball 220 to each other. The centering depressions 233 may be formed in the other one of the first impact ball 210 and the second impact ball 220 as a plurality of depressions, and may be fitted over the centering protrusions 232.

Accordingly, the first impact ball 210 and the second impact ball 220 may be prevented from being freely rotated in the circumferential direction by the combination of the centering protrusions 232 and the centering depressions 233.

The fastening bolts 234 may fix the first impact ball 210 and the second impact ball 220 in a coupled state by fastening the first impact ball 210, the buffer plate 231, and the second impact ball 220 therethrough.

Meanwhile, as shown in FIGS. 4 and 7, the above-described metal region 500 may be divided into the first region 510 and the second region 520, and the resulting regions may be formed to have different outer diameters.

In other words, the first region 510 and the second region 520 may be formed to have different outer diameters, and thus, may hold the impact ball 200 by an attractive force having a different strength depending on the position of the impact ball 200 through an attractive force acting at a different strength depending on the outer diameter.

The first region 510 is a component for holding the impact ball 200 by an attractive force having a stronger strength.

More specifically, the first region 510 is formed to have a larger outer diameter while forming a part of the metal region 500 on the grip (110) side, and thus, is spaced apart from the magnets 300 of the impact ball 200 at a shorter interval, thereby holding the impact ball 200 by an attractive force having a stronger strength.

The second region 520 is a component for holding the impact ball 200 by an attractive force having a weaker strength.

More specifically, the second region 520 is formed to have a smaller outer diameter than the first region 510 while forming the remaining part of the metal region 500 on the side opposite to the grip 110, and thus, is spaced apart from the magnets 300 at a longer interval than the first region 510, thereby holding the impact ball 200 by an attractive force having a weaker strength than the first region 510.

In other words, when the impact ball 200 is formed of a single first impact ball 210, as shown in FIG. 4, and is located around the first region 510, the first magnets 310 are spaced apart from the first region 510 at a shorter interval, and thus, may be held by an attractive force having a stronger strength.

Furthermore, when the first impact ball 210 is located around the second region 520, the first magnets 310 are spaced apart from the second region 520 at a longer interval, and thus, may be held by an attractive force having a weaker strength.

Meanwhile, the above-described second impact ball 220 may be formed to have an inner diameter smaller than the outer diameter of the first region 510 while being formed to have an inner diameter smaller than the inner diameter of the first impact ball 210, as shown in FIG. 6.

Accordingly, the second impact ball 220 may be held only to the second region 520 through the second magnets 320 while being prevented from moving to the first region 510, and may be held to the second region 520 by a stronger attractive force than the first impact ball 210 because the second magnets 320 are spaced apart from the second region 520 at a shorter interval than the first magnets 310.

In summary, when the impact ball 200 is formed of the first impact ball 210 and the second impact ball 220, the impact ball 200 may be held to the metal region 500 by attractive forces having three levels of strength, as shown in FIGS. 7 to 9.

Referring to FIG. 7, when the impact ball 200 is located around the second region 520 only through the first impact ball 210, it is held to the second region 520 only through the first magnet 310, so that it may be held by an attractive force having the weakest one of the three levels of strength.

Therefore, when the shaft body 100 is swung, the impact ball 200 may be moved toward the stopper 120 while being separated from the metal region 500 even by a weaker centrifugal force, thereby providing a sensation of hitting.

Referring to FIG. 8, when the impact ball 200 is located around the second region 520 through the first impact ball 210 and the second impact ball, it may be held to the second region 520 through the first magnet 310 and the second magnet 320 and also be held by an attractive force having the intermediate one of the three levels of strength because the first magnet 310 is spaced apart from the first region 510 at a longer interval.

Referring to FIG. 9, when the impact ball 200 is located around the first region 510 through the first impact ball 210 and is also located around the second region 520 through the second impact ball, it is spaced apart from the first region 510 at a shorter interval through the first magnet 310 and is also spaced apart from the second region 520 at a shorter interval through the second magnet 320, so that it may be held by an attractive force having the strongest one of the three levels of strength.

Accordingly, when the shaft body 100 is swung, the impact ball 200 may be moved toward the stopper 120 while being separated from the metal region 500 only by a stronger centrifugal force, thereby providing a sensation of hitting.

Meanwhile, the golf swing training apparatus 10 according to an embodiment may be configured to further include an IR light emitter 700, as shown in FIG. 1.

The IR light emitter 700 is a component that emits infrared rays for tracking the movement of the shaft body 100 by a sensor (not shown).

The IR light emitter 700 may be installed at the front end of the shaft body 100 or on at least one of the impact ball 200 and the stopper 120, and may emit infrared rays. Data for tracking the movement of the shaft body 100 may be provided to a server (not shown) by being detected through a sensor (not shown).

Accordingly, the server may detect the movement or movement trajectory of the shaft body 100 via the IR light emitter 700 detected through the sensor, and may obtain, provide, and store various types of data such as the number of times, trajectories, accuracy, and/or the like according to the practice of the swing of the shaft body based on the detected IR light emitter 700.

A method of using the golf swing training apparatus 10 including the above-described components according to an embodiment will be described.

The impact ball 200 may be fixed at a predetermined position of the metal region 500 through the magnetic force of the magnet 300 while being moved by a user.

In this case, a selected number of magnets 300 are coupled into the fitting slots 400 of the impact ball 200, thereby adjusting the strength of the magnetic force.

The magnets 300 may be coupled into all the fitting slots 400 of the impact ball 200 when a setting is made to provide a stronger magnetic force, and may be coupled only into some of the fitting slots 400 when a setting is made to provide a weaker magnetic force.

The impact ball 200 may be fixed to the metal region 500 through the magnetic force provided according to the number of magnets 300.

In addition, when the impact ball 200 is formed of the first impact ball 210 and the second impact ball 220 and the metal region 500 is formed of the first region 510 and the second region 520, it is fixed in a state of being located around the second region 520 only through the first impact ball 210 and the first magnet 310, so that it may provide the center of gravity toward the lower part of the shaft body 100 while being fixed by the weakest attractive force.

Unlike this, the impact ball 200 is fixed in a state of being located around the second region 520 through the first impact ball 210 and the second impact ball 220, so that it may be fixed by an intermediate-level attractive force.

Unlike these, the impact ball 200 is fixed while being located around the second region 510 and the first region 520 through the first impact ball 210 and the second impact ball 220, respectively, so that it may provide the center of gravity toward the grip of the shaft body 100 while being fixed by the strongest attractive force.

The shaft body 100 is swung while being held by a user through the grip 110.

In this case, the impact ball 200 is separated from the metal region 500 by the centrifugal force caused by the swing of the shaft body 100, moves along the ball rail 130, and hits the stopper 120, thereby providing a sensation of hitting.

In this case, when the impact ball 200 is fixed by a weaker attractive force, it may be separated from the metal region 500 even by a weaker centrifugal force. In contrast, when the impact ball 200 is fixed by a stronger attractive force, it may be separated from the metal region 500 only when a stronger centrifugal force is applied. Accordingly, it may be possible to adjust the strength of swing practice.

As described above, according to the golf swing training apparatus 10 according to the embodiment, the plurality of magnets 300 providing a magnetic force are detachably coupled into the fitting slots 400 formed in the impact ball 200, and thus the strength of the magnetic force may be adjusted by adjusting the number of magnets 300, so that the strength of the action of attraction can be adjusted through the different strengths of magnetic forces, thereby providing a variety of sensations of weight.

The above-described embodiments are intended for illustrative purposes. It will be understood that those of ordinary skill in the art to which the present invention pertains can easily make modifications and variations without changing the technical spirit and essential features of the present invention. Therefore, the above-described embodiments are illustrative and are not limitative in all aspects. For example, each component described as being in a single form may be practiced in a distributed form. In the same manner, components described as being in a distributed form may be practiced in an integrated form.

The scope of protection pursued via the present specification should be defined by the attached claims, rather than the detailed description. All modifications and variations which can be derived from the meanings, scopes and equivalents of the claims should be construed as falling within the scope of the present invention.

The invention claimed is:

1. A golf swing training apparatus for providing sensations of hitting for golf swing practice, the golf swing training apparatus comprising:

a shaft body formed to a predetermined length, and configured such that a grip and a stopper are formed at both ends thereof, respectively, in a longitudinal direction thereof and a metal region made of a metallic material is formed in a part thereof on a grip side thereof;

an impact ball coupled to be movable along the longitudinal direction of the shaft body, configured to provide weight for generation of a sensation of hitting while being moved in a direction opposite to the grip by a centrifugal force caused by a swing of the shaft body and then being stopped by the stopper, and provided with a plurality fitting slots; and a plurality of magnets configured to be detachably fitted into one or more of the fitting slots of the impact ball, configured to hold the impact ball to the metal region through an action of attraction with the metal region while providing a magnetic force, and configured to allow a strength of the action of attraction to be adjusted while providing a magnetic force having a different strength depending on a number of magnets coupled into the fitting slots, wherein the metal region is divided into a plurality of regions, and the plurality of regions are formed to have different outer diameters, respectively.

2. The golf swing training apparatus of claim 1, wherein each of the fitting slots comprises an exposure opening formed as an opening depressed from one end of the impact ball to an opposite end thereof in a longitudinal direction of the impact ball and configured to accommodate each of the magnets and to be opened toward an inner surface of the impact ball and allow the magnet to face the metal region while being exposed to the inner surface of the impact ball.

3. The golf swing training apparatus of claim 1, further comprising a weight block having a same shape and weight as each of the magnets and configured to be coupled into a fitting slot into which the magnet is not coupled among the fitting slots of the impact ball and to provide a weight corresponding to the magnet.

4. The golf swing training apparatus of claim 1, wherein:

the impact ball comprises a first impact ball formed in a ring shape having an inner diameter larger than an outer diameter of the metal region and configured such that the fitting slots are formed in a radial arrangement along an inner circumference thereof and accommodate the magnets; and the magnets comprise a plurality of first magnets formed to have a cross section corresponding to the fitting slots and configured to face the metal region at a predetermined interval while being selectively coupled into the fitting slots.

5. The golf swing training apparatus of claim 4, wherein:

the impact ball further comprises:

a second impact ball formed in a ring shape having an inner diameter larger than the outer diameter of the metal region, configured to move together with the first impact ball while being coupled to the first impact ball, and also configured such that the fitting slots are formed in a radial arrangement along an inner circumference thereof and accommodate the magnets; and a ball fixing part configured to fix the second impact ball to the first impact ball; and the magnets comprise a plurality of second magnets formed to have a cross section corresponding to the fitting slots of the second impact ball and configured to face the metal region at a predetermined interval while being selectively coupled into the fitting slots.

6. The golf swing training apparatus of claim 5, wherein:

the second impact ball is formed to have an inner diameter smaller than the inner diameter of the first impact ball; and the metal region comprises:

a first region formed to have a larger outer diameter while forming a part of the metal region, and configured to face the first magnets of the first impact ball at a predetermined interval; and a second region formed to have a smaller outer diameter than the first area while forming a remaining part of the metal region, and configured to face the first magnets of the first impact ball and the second magnets of the second impact ball at predetermined intervals, the second region facing the first magnets at a longer interval and facing the second magnets at a shorter interval.

7. The golf swing training apparatus of claim 5, wherein the ball fixing part comprises:

a buffer plate configured to be fixed in a state of being interposed between the first impact ball and the second impact ball;

a centering protrusion protruding from one of the first impact ball and the second impact ball, and configured to pass through the buffer plate;

a centering depression formed in a depression form in a remaining one of the first impact ball and the second impact ball, and configured to receive the centering protrusion; and a fastening bolt configured to be fastened through the first impact ball, the buffer plate, and the second impact ball.

8. The golf swing training apparatus of claim 5, wherein the second impact ball has a different weight from that of the first impact ball.

9. The golf swing training apparatus of claim 5, wherein the second impact ball has a different inner diameter from that of the first impact ball.

10. The golf swing training apparatus of claim 1, further comprising an IR light emitter configured to be installed on at least one of the shaft body and the impact ball and to emit infrared rays for tracking of movement of the shaft body.

* * * * *